United States Patent [19]

Betts

[11] Patent Number: 4,672,897

[45] Date of Patent: Jun. 16, 1987

[54] IMPACTOR CAP

[75] Inventor: Robert E. Betts, Huntsville, Ala.

[73] Assignee: The United States of America as represented by the Secretary of the Army, Washington, D.C.

[21] Appl. No.: 859,599

[22] Filed: May 5, 1986

[51] Int. Cl.[4] ..... F42B 11/16

[52] U.S. Cl. ..... 102/513; 102/204

[58] Field of Search ..... 102/204, 210, 272, 273, 102/513

[56] References Cited

U.S. PATENT DOCUMENTS

| | | | |
|---|---|---|---|
| 2,415,262 | 2/1947 | Semple | 102/273 |
| 2,892,411 | 6/1959 | Brown et al. | 102/210 |
| 3,119,337 | 1/1964 | Przychowski | 102/273 |
| 4,488,490 | 12/1984 | Betts . | |

*Primary Examiner*—Harold J. Tudor

*Attorney, Agent, or Firm*—John C. Garvin, Jr.; Freddie M. Bush

[57] ABSTRACT

An improvement is disclosed in the method of initiating an explosive charge carried to a target site by a rocket launched toward a target whereupon striking a soft target the performance functioning of a percussion primer to a spotting charge is improved by an impactor-cap device in communication with the percussion primer whereby the impactor will indent the primer with sufficient energy and depth to cause functioning. The impactor-cap device is comprised of a cap portion and an impactor portion. The cap portion is in the form of a thin plastic cup of a material selected from polyethylene, nylon, mylar, or cellulose acetate. The impactor portion is in the form of a ball or spike of hard material such as a steel ball, glass ball, or high impact strength plastic such as polycarbonate, methyl methacrylate (Plexiglas), or nylon. The impactor-cap device is designed to form a contoured fit with the ogive of the spotting head, and a small amount of adhesive is applied to the inside surface of the cap to hold the cap whereby the impactor is retained within the cap portion wherein orientation is achieved to align and hold the impactor in proper position to the percussion primer whereupon striking a soft target increased performance and reliability is achieved.

2 Claims, 4 Drawing Figures

IMPACTOR CAP

DEDICATORY CLAUSE

The invention described herein may be manufactured, used, and licensed by or for the Government for governmental purposes without the payment to me of any royalties thereon.

BACKGROUND OF THE INVENTION

Percussion initiated rockets function on impact to perform a task in accordance with the design criteria.

In an earlier design, a percussion initiated spotting charge has been used as an explosive warhead on small practice rockets. One such explosive warhead includes a spotting head employing a stab primer for initiation of the spotting charge. In this device the firing pin, used to initiate the primer, is held off the primer prior to launch by a spring-weight arrangement. On acceleration, the weight with the hole in its center compresses the spring and locks to the firing pin with the tip end of the firing pin protruding through the weight. On deceleration, the springweight firing pin moves forward striking the primer and setting off the body charge. Such an arrangement has safety problems in handling prior to and during launch. Also, one disadvantage is that mechanical mechanisms tend to hang-up on deceleration and causes non-functioning on soft target. Hang-up also causes non-arming on acceleration as well. Therefore, it can be seen that there is a need for a device that has no moving parts, that is safe to operate and handle, and that is reliable in operation.

The need for a device with no moving parts was satisfied with an improved design disclosed in my prior U.S. Pat. No. 4,488,490 issued on Dec. 18, 1984 and assigned to the United States of America as represented by the Secretary of the Army, Washington, D.C. This assigned patent also provides detailed disclosures, including FIGS. 1, 2, and 3 which illustrate a view of a percussion initiated spotting charge at rest, a view of a percussion initiated spotting charge as it is being accelerated, and a view of a percussion initiated spotting charge which depicts the position of the various elements upon deceleration or target contact of the various elements My improved device of U.S. Pat. No. 4,448,490 for use with a solid propellant rocket motor comprises a motor closure head having a percussion initiated spotting charge mounted on the motor closure head. The percussion initiated spotting charge in accordance with my earlier design includes a body made of a material sufficient for withstanding the acceleration forces and has a chamber with a pyrotechnic contained therein and said body has at one end thereof a lead material that is supported with a jacket material inside a front portion of the body structure and the lead structure has a percussion primer mounted at one end thereof and a chamber and hole communicates from the percussion primer to the pyrotechnic to cause the percussion primer to be communicated directly with the pyrotechnic and set the pyrotechnic charge off upon contacting a target.

A deficiency of my improved device, described hereinabove, has recently come to light wherein the deficiency was prevalent when environment of use included impacting with very soft targets such as soft earth or mud. In this environment an assist is needed to increase the performance of my earlier device by causing functioning on very soft targets.

Accordingly, it is an object of this invention to provide a percussion initiated spotting charge for a solid propellant rocket that has no moving parts and which additionally includes an attached member which causes functioning of the percussion initiated charge when the attached member impacts with very soft target such as mud or soft earth.

Another object of this invention is to provide a percussion initiating spotting charge in which each of the elements are made from relatively inexpensive materials but yet reliable, and wherein said attached member to initiate functioning on impacting with very soft targets is easily installed.

Still another object of this invention is to provide a relatively light and compact percussion initiated spotting charge having a spotting head member and an attached member which is in the form of an impactor-cap designed to form a contoured fit with the ogive of said spotting head.

SUMMARY OF THE INVENTION

An impactor-cap device is disclosed for attaching to a percussion initiated rocket spotting charge at the spotting head portion thereof to form a contoured fit with the ogive of the spotting head. The cap portion is in the form of a thin plastic cup formed of polyethylene, nylon Mylar (Trademark owned by du Pont de Nemours and Co., Inc., E. I., for polyethylene terephthalate film), or cellulose acetate with a very small amount of adhesive in inside portion for securing to the ogive of the spotting head. The impactor portion is in the form of a ball or spike of hard material such as a steel ball, glass ball, or high impact strength plastic selected from polycarbonate, methyl methacrylate (Plexiglas) or nylon.

The impactor-cap device is installed just prior to use by placing the impactor-cap device on the spotting head whereby the adhesive material ensures a contour fitting of the cap with the ogive and a precise orientation of the impactor with the spotting head portion.

In operation, since the mass of the impactor is small it does not cause percussion cap initiation even at high G-loading, but on impact with a soft target such as mud or soft earth, the impactor will indent the primer with sufficient energy and depth to cause functional operation of the percussion initiated rocket spotting charge.

DESCRIPTION OF THE PREFERRED EMBODIMENT

Figure 1:
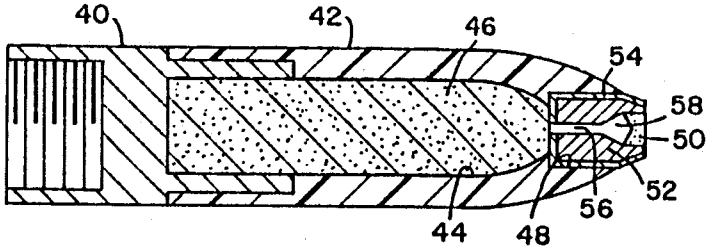
FIG. 1 PRIOR ART
FIG. 1 is an enlarged view illustrating a percussion initiated spotting charge in accordance with recent prior art design.
Figure 2:
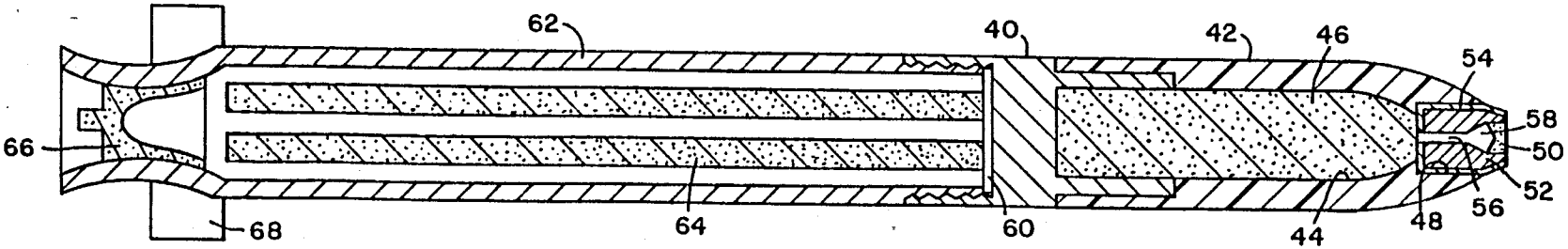
FIG. 2 PRIOR ART
FIG. 2 is a view of a rocket motor with the percussion initiated spotting charge mounted at the front end of the rocket in accordance with recent prior art design.

In order to concisely focus attention to the improvement achieved by the impactor-cap device of this invention, a full description of FIGS. 1 and 2 relating to the prior art are first set forth.

Referring now to FIG. 1, a very compact and precision built percussion initiated spotting charge of the prior art is disclosed and includes a motor head closure 40 with a percussion initiated spotting charge body 42 of a light weight material, such as a light nylon material, sufficient to withstand the acceleration forces. The percussion initiated spotting charge body is connected to motor head structure 40. The percussion initiated spotting charge body has a cavity 44 therein that is filled with a pyrotechnic spotting charge 46. Spotting charge 46 is preferably made as a pyrotechnic which has by weight 24 percent aluminum powder, 66 percent potassium perchlorate and 10 percent sulfur. This has been found to be a good pyrotechnic for this type spotting charge. The front end of percussion initiated spotting charge body 42 has a bore 48 therein that receives the structure that mounts percussion primer 50. Percussion primer 50 is mounted in a lead structure 52 that is supported by a supporting jacket 54 that is made of copper or other equivalent material. It is noted that jacket 54 completely closes the outer circumference of body 52 as well as one end of body 52. Body 52 has a bore 56 and a cavity 58 that communicate the percussion primer charge to the pyrotechnic spotting charge 46 when percussion primer 50 is set off by impact of percussion primer 50 with a target.

Motor head closure 40 is designed for clamping propellant plate holder 60 to one end of rocket motor case 62 as illustrated in FIG. 2. Propellant holder plate 60 positions propellant sticks 64 within rocket motor case 62. The rear end of rocket motor case 62 has a conventional ignitor and closure 66 for closing the rocket motor chamber and for igniting the rocket motor when desired. The rocket motor case also has conventional fin structure 68 for stabilizing flight of the rocket.

In operation, when it is desired to fire the rocket, ignitor 66 is initiated to ignite propellant 64 and cause the rocket to be launched toward the desired target. When percussion primer 50 strikes the target, percussion primer 50 is set off and the explosion thereof is communicated through chamber 58 and passage 56 to pyrotechnic spotting charge 46 and this charge is then set off.

The above described combination has a high reliability when impacting on a hard target; however, should the rocket with spotting charge impact on a soft target, such as mud or soft earth material, the above described combination is subject to not functioning for the desired mission.

Figure 3:
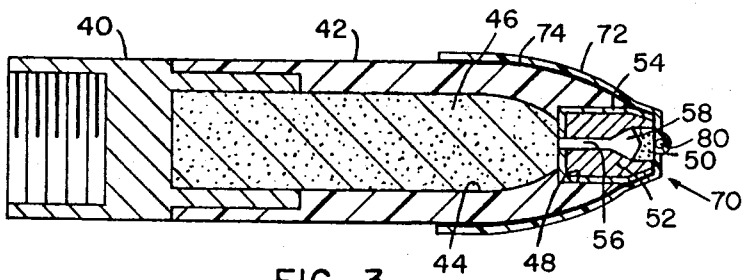
FIG. 3 is an impactor-cap device attached to a percussion initiated spotting charge of FIG. 1.
Figure 4:
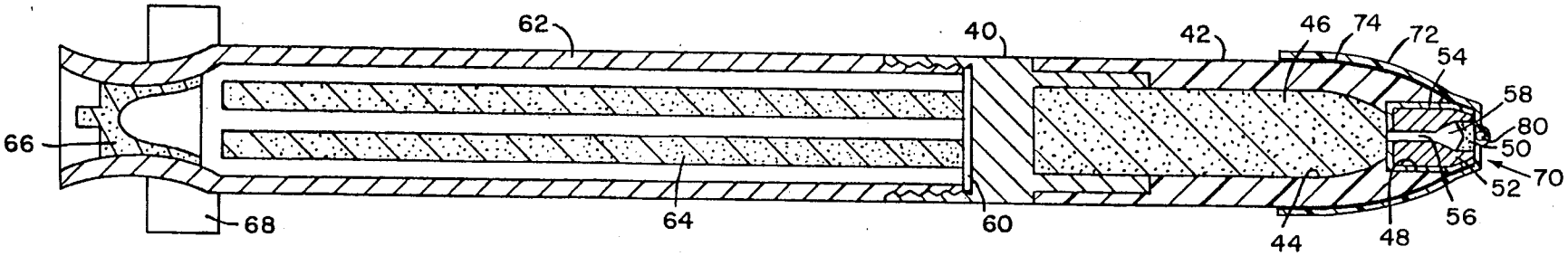
FIG. 4 is an impactor-cap device attached to a percussion initiated spotting charge and mounted at the front end of a rocket motor of FIG. 2.

Thus, as further illustrated in FIGS. 3 and 4, the impactor-cap device 70 of this invention is shown fitted snugly with the percussion initiated spotting charge body 42. The cap portion 72 is in the form of a thin plastic, cup made of a material selected from polyethylene, nylon, Mylar or cellulose acetate with a very small amount of a pressure sensitive adhesive 74 for securing a snug fit with the percussion initiated spotting charge body 42. The impactor portion 80 of the impactor-cap device is in the form of a ball or spike of hard material selected from steel, glass, or a high impact strength plastic selected from polycarbonate, methyl methacrylate (Plexiglas), or nylon.

The impactor-cap device is installed just prior to rocket launch or firing. The impactor is a small hard body, and since the mass of the impactor is small, it does not cause percussion cap initiation even at high G-loading, but on impact with a soft target such as mud or soft earth material the impactor will indent the primer 50 with sufficient energy and depth to cause functioning by setting off the percussion primer 50. The explosion is communicated through chamber 58 and passage 56 to pyrotechnic spotting charge 46 and this charge is then set off.

I claim:

1. An impactor-cap device in combination with a percussion primer which functions to indent said percussion primer for initiating an explosive charge carried to a target site bya rocket launched toward a target whereupon striking soft target said percussion primer is set off by said impactor-cap device and the explosion thereof is communicated through a chamber and passage diectly connecting apyrotechnic spotting charge to in turn set off said pyrotechnic spotting charge, said impactor-cap device comprising a cap portion and an impactor portion, said cap portion constructed of a thin plastic cup of a material selected from polyethylene, nylon, polyethylene terephthalate, or cellulose acetate, said thin plastic cup forming a contoured fit with said percussion primer, said impactor portion being retained within said cap portion which precisely orients said impactor portion with said percussion primer, said impactor portion being in the form of a ball of low mass constructed of a material selected from the group of materials consisting of steel, glass, and a high impact strength plastic material selected from the group of high impact strength plastic materials consisting of polycarbonate, methyl methacrylate, and nylon, said impactor being of low mass which does not cause percussion cap initiation even at high G-loading, but upon impacting with a soft target such as mud or soft earth material, the impactor indents said percussion primer with sufficient energy and depth to cause functional performance of said percussion primer after initiation by said impactor-cap device.

2. A rocket having a percussion initiated spotting charge comprising a percussion spotting charge initiated head closure, an elongated body secured to said percussion initiated spotting charge head closure and having a chamber defined therein and having an outer surface that is tapered inwardly at the leading front end thereof, a pyrotechnic spotting charge positioned in and filling said chamber of said elongated body, said elongated body having a bore opening in the leading and front end thereof and extending to said chamber, a percussion primer mounted in a leading end portion of a malleable body and said malleable body having a chamber defined therein and having a passage therein from the chamber thereof to a remote end of the malleable body that is adjacent said pyrotechnic spotting charge and a jacket on an outer radial surface of said malleable body and on an end of said malleable body remote from said percussion primer, said passage continuing through said jacket at said end and said malleable body and said jacket being secured in said bore opening of said elongated body with a portion of said jacket end in contact with said pyrotechnic spotting charge and an opposite leading end that projects beyond the front end of said bore opening, the improvement comprising an impactor-cap device snugly fitted to said jacket end and said opposite leading end portion, said impactor-cap device comprising a cap portion and an impactor portion, said cap portion in the form of a thin plastic cup forming a contoured fit with said percussion initiated spotting head and said impactor portion being retained within said cap portion which precisely orients said impactor whereby when the rocket is launched toward a target and said impactor-cap device strikes a soft target, said impactor portion indents said percussion primer with sufficient energy and depth to cause functioning of said percussion primer to set off an explosion thereof which is communicated through said chamber and said passage directly to the pyrotechnic spotting charge to in turn set off the pyrotechnic spotting charge, said thin plastic cup constructed of a material selected from the group of material consisting of polyethylene, polyethylene terephthalate, nylon, or cellulose acetate, and said impactor in the form of a ball of small mass constructed of a material selected from the group of materials consisting of steel, glass, and a high impact strength plastic material selected from the group of high impact strength plastics consisting of polycarvonate, methyl methacrylate, and nylon.

* * * * *